US006537114B2

(12) United States Patent
Evans

(10) Patent No.: US 6,537,114 B2
(45) Date of Patent: Mar. 25, 2003

(54) ADJUSTABLE SWIM FIN

(76) Inventor: Robert B. Evans, 715 Kimball Ave., Santa Barbara, CA (US) 93103

( * ) Notice: Subject to any disclaimer, the term of this patent is extended or adjusted under 35 U.S.C. 154(b) by 0 days.

(21) Appl. No.: 09/975,632

(22) Filed: Oct. 10, 2001

(65) Prior Publication Data

US 2002/0025745 A1 Feb. 28, 2002

Related U.S. Application Data

(63) Continuation of application No. 09/549,088, filed on Apr. 13, 2000.

(51) Int. Cl.[7] ..... A63B 31/08
(52) U.S. Cl. ..... 440/64
(58) Field of Search ..... 441/55, 61–64; D21/806

(56) References Cited

U.S. PATENT DOCUMENTS

| | | | | | |
|---|---|---|---|---|---|
| D132,377 | S | * | 5/1942 | Smith | D21/806 |
| 2,423,571 | A | | 7/1947 | Wilen | |
| 3,055,025 | A | * | 9/1962 | Ferraro et al. | 441/64 |
| 3,183,529 | A | | 5/1965 | Beuchat | |
| 3,422,470 | A | * | 1/1969 | Mares | 441/64 |
| 3,908,213 | A | | 9/1975 | Hill | |
| 4,737,127 | A | | 4/1988 | Lamont | |
| 5,634,613 | A | | 6/1997 | McCarthy | |
| 5,709,575 | A | * | 1/1998 | Betrock | 441/64 |
| 5,746,631 | A | | 5/1998 | McCarthy | |
| D426,865 | S | * | 6/2000 | Evans | D21/806 |
| D440,272 | S | * | 4/2001 | Evans | D21/806 |
| 6,354,894 | B1 | * | 3/2002 | Evans | 441/64 |

FOREIGN PATENT DOCUMENTS

| | | | | |
|---|---|---|---|---|
| IT | 506009 | * | 1/1957 | 441/64 |

OTHER PUBLICATIONS

Fax letter to Dan Cislo, dated Nov. 30, 1999, from Susanne Chess, regarding, "New rotational method for adjusting the pitch, tension, stiffness or orientation of a hydrofoil and its effect on the flow of water," 5 pages.

* cited by examiner

*Primary Examiner*—S. Joseph Morano
*Assistant Examiner*—Ajay Vasudeva
(74) *Attorney, Agent, or Firm*—Cislo & Thomas LLP

(57) ABSTRACT

Spear-bladed swim fins provide new means by which divers may propel themselves through the water. Spear-bladed swim fins generally provide a lower surface area to a higher perimeter edge length. By reducing the effective surface area of the swim fin, more propulsive force is delivered by the fin for each kick of the diver. Such dispersion of the diver's energy may be particularly advantageous where stationery swimming is required, as for underwater photography. Additionally, vortices generated during swim kicks may advantageously complement the operation of the swim fin. In the first embodiment, the spear blade is narrow. In a second embodiment, the spear blade is wider but has a larger channel through which water can flow to eliminate dead spots on the lee side of the fin. Fork extension stubs present with the foot pocket of the swim fin provide an adjustable means by which the flexing, bowing, and/or geometry of the swim fin blade may be adjusted according to the preferences and/or demands of the diver.

15 Claims, 8 Drawing Sheets

30
36
36
32
50
52
38
60
62
34

4.
60
4.
34
30
62
62
5.
5.
80
66
3.
64
70
72
6.
3.
6.
52
74
50
82

66
34

60
34

34

66
80
64
34

Fig. 7.
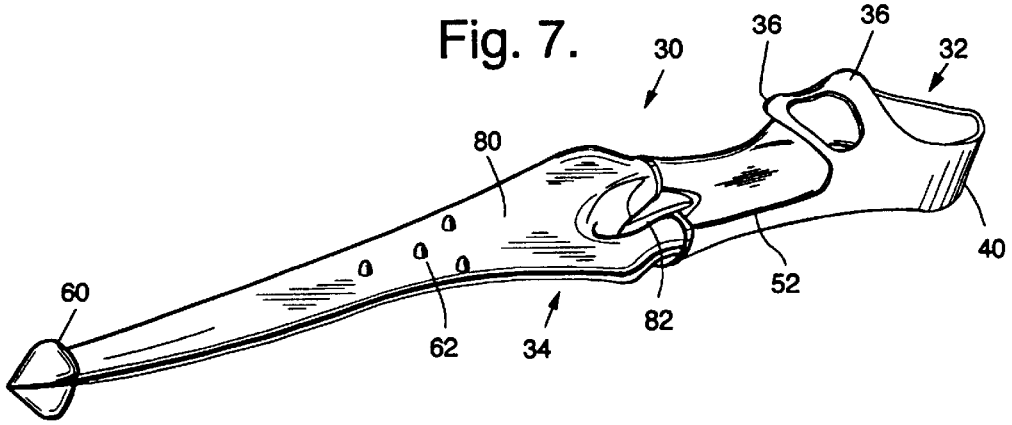
Fig. 8.
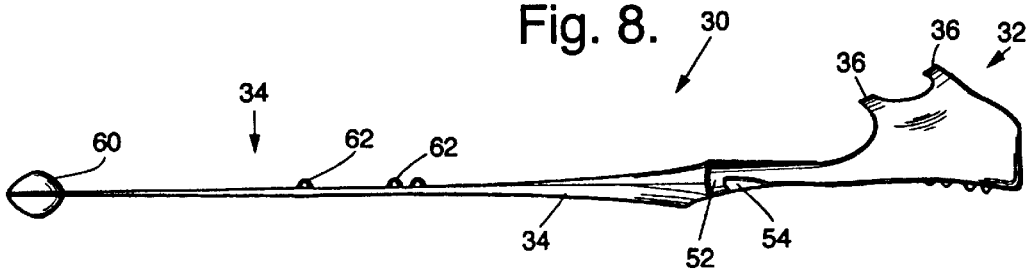
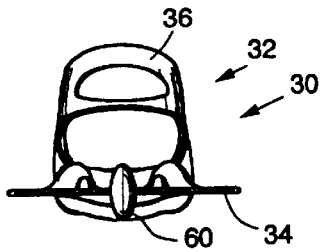
Fig. 9.
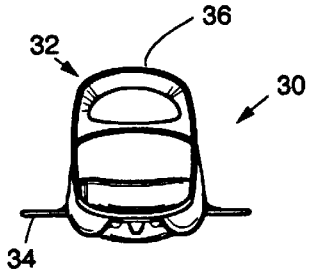
Fig. 10.

Fig. 14.
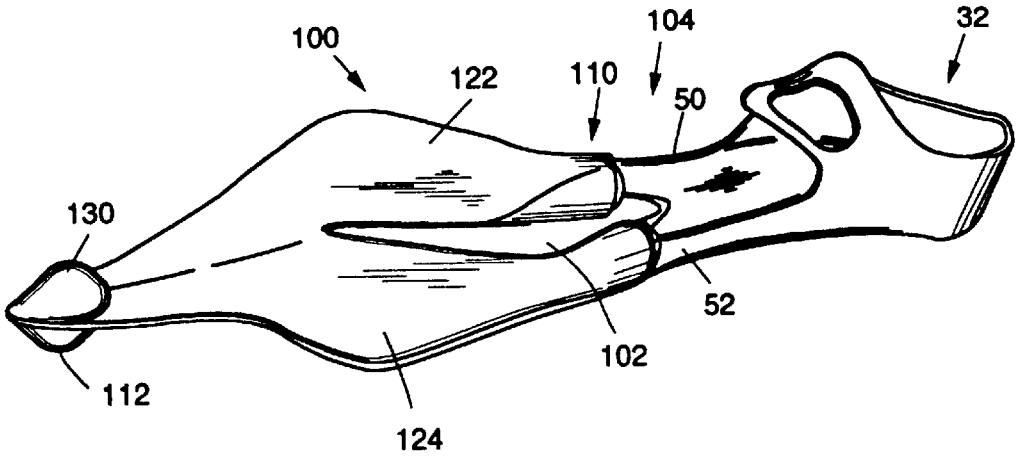
Fig. 15.
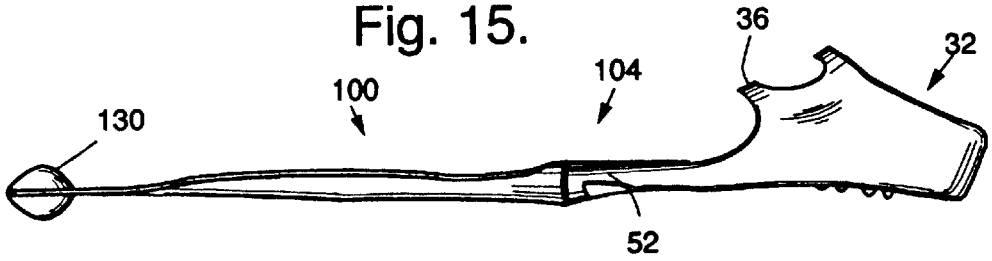
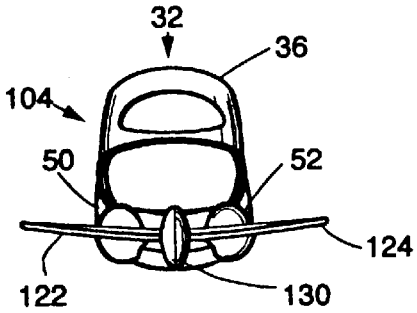
Fig. 16.
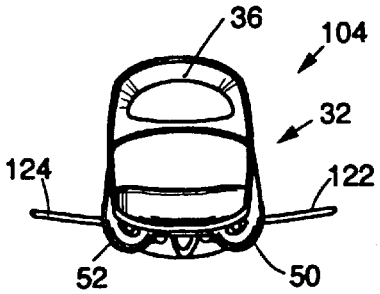
Fig. 17.

ADJUSTABLE SWIM FIN

This patent application is a continuation of U.S. patent application Ser. No. 09/549,088 filed Apr. 13, 2000 for ADJUSTABLE SWIM FIN, which application is incorporated herein by this reference thereto.

BACKGROUND OF THE INVENTION

1. Field of the Invention

This invention relates to swim fins and more particularly swim fins of an advanced design that will allow canceling vortices and better propulsion.

2. Description of the Related Art

With the advancement of scuba diving and snorkeling, swim fins have likewise developed in order to propel the diver through the water. As with the swimming fins of fish, swim fins for human beings have certain dynamic characteristics that provide for different types of propulsion through the water.

The analogy with fish and aquatic mammal fins is particularly apropos, as such fish fins serve to propel fish ranging in size from the smallest minnow to the largest whale. Additionally, if the rules of natural selection are assumed, the development of fish fins for particular activities serves as an indication of advantageous architecture to be adopted in diving fins.

Different species of fish and fish living in different environments have adapted over the thousands of generations to both interspecies and intraspecie competition so that those fish with the most efficient or better fin configuration, geometry, or architecture have a better advantage with respect to other members of their species not so endowed. Over time, advantageous characteristic features are adopted while detrimental or disadvantageous features are eliminated, as individual members of the species compete against one another. As fish are especially adapted for swimming and living in aquatic environments, the arrangement, structure, and architecture of the fins, particularly the fins used for propulsion, are a significant element to the fish's anatomy and its ability to compete and survive with respect to other members of the species.

Ichthyologists characterize fish in a number of ways according to their body type and habitat. Some fish live generally at the surface of the water, others at the bottom, some around coral reefs, and some are deep water, pelagic, fish that are generally in a constant state of motion and generally always swimming. The rear propulsion, or tail, fin of the fish is known as the caudal fin, and may take a number of forms. These include a rounded caudal fin, a truncate caudal fin, a forked caudal fin, and a lunate caudal fin.

Fish with truncate or rounded caudal fins are usually strong swimmers, but are generally slow. Apparently, such truncate or rounded caudal fins provide strength but not speed to the propulsive force of the fish while swimming due to the greater centralized surface area of such caudal fins. Fish with forked caudal fins are generally those that continuously swim. An example of such fish are sharks, which, having no swim bladder, must continually swim in order to maintain their buoyancy. In some sharks, the top fork of the forked caudal fin is elongated to increase the upward force on the fish to hold its vertical position in the water as it swims. Fish with lunate caudal fins tend to be the fastest fish, with such fish being able to maintain relatively high speeds for long durations. Such fish include tuna, mackerel, and jacks, which have a fusiform shape and are generally the fastest fish in the ocean. The oscillating motions of the common eel, or the quick acceleration of an alligator's whipping tail provides models upon which aquatic propulsion systems (including swim fins) can be based.

Most bladed swim fins, particularly those often used in conjunction with scuba and skin diving, are bladed fins having a pair of rails extending outwardly from a foot pocket. Webbing is present in the form of elastic or plastic webbing that forms a blade by which the diver propels him- or herself. Such swim fins often resemble the rounded or truncate caudal fins present on fish. Consequently, such swim fins provide strength, but generally not speed. As a result, skin and scuba divers swimming around reefs and trying to cover longer distances in calm waters must generally work harder in order to propel themselves faster. Additionally, such bladed swim fins are not adjustable, the lateral rails and the blade webbing not providing any adjustment with respect to the foot pocket.

By taking advantage of the development in fish fins nature has achieved, a swimmer or diver could better propel him- or herself by adopting a swim fin blade configuration that allows for greater speed and easier propulsion.

SUMMARY OF THE INVENTION

The present invention provides advancement on the order of swim fins and the like by providing a spear-bladed swim fin. The spear-bladed swim fins of the present invention are generally dissimilar to those found in nature and provide the unique means by which a diver may propel himself through the water.

Two embodiments of the spear-bladed swim fin are currently contemplated: a narrow spear-bladed swim fin and a wider, more rounded spear-bladed swim fin. All embodiments of the present invention may incorporate speed bumps or speed pods that may be used to prevent the formation of dead areas as the diver kicks the fin through the water for propulsion. Alternatively, such pods may be used as counterweights for the undulating fin portion or to create beneficial vortices. Additionally, a foot pocket having fork extension stubs or the like provides means by which the pitch, tension, stiffness, orientation, and/or geometry of the attached spear-bladed swim fin may be resiliently and selectably adjusted.

Amongst several advantages provided by the spear-bladed swim fins set forth herein, novel means are provided by which water may be used for propulsion and the turbulence and disturbance created by these swim fins may be accommodated by its several features. Undulation of the fins also provides propulsion. Vortices generated by the movement of the swim fins through the water may complement the operation of the swim fins.

OBJECTS OF THE INVENTION

It is an object of the present invention to provide a spear-bladed swim fin.

It is yet another object of the present invention to provide a spear-bladed swim fin that is adjustable in its flexion, tension, pitch, geometry and/or a combination of each.

It is yet another object of the present invention to provide a spear-bladed swim fin that incorporates speed pods or the like to reduce dead areas, provide a counterweight, or create beneficial vortices.

It is yet another object of the present invention to provide a spear-bladed swim fin that may incorporate winglets or the like to control water flow over the fin surface.

It is yet another object of the present invention to provide a system of spear-bladed swim fins that may be interchangeably exchanged between similar foot pockets.

These and other objects and advantages of the present invention will be apparent from a review of the following specification and accompanying drawings.

BRIEF DESCRIPTION OF THE DRAWINGS

FIG. 7 is a left side perspective view of the spear-bladed swim fin shown in FIG. 1 without clock washers.

FIG. 8 is a left side elevational view of the spear-bladed swim fin shown in FIG. 7. The right side view is a mirror image of the left side view.

FIG. 9 is a front elevational view of the swim fin shown in FIG. 7.

FIG. 10 is a rear elevational view of the swim fin shown in FIG. 7.

FIG. 14 is a left side perspective view of an alternative embodiment of the present invention having a a larger aperture and wider flared portions.

FIG. 15 is a left side elevational view of the swim fin shown in FIG. 14. The right side view is a mirror image of the left side view.

FIG. 16 is a front elevational view of the swim fin shown in FIG. 14.

FIG. 17 is a rear elevational view of the swim fin shown in FIG. 14.

FIGS. 20A–C show the significant difference in the flexing of the spear-bladed swim fin blade when adjusted upon the fork extension stubs of the foot pocket.

DESCRIPTION OF THE PREFERRED EMBODIMENT(S)

Figure 1:
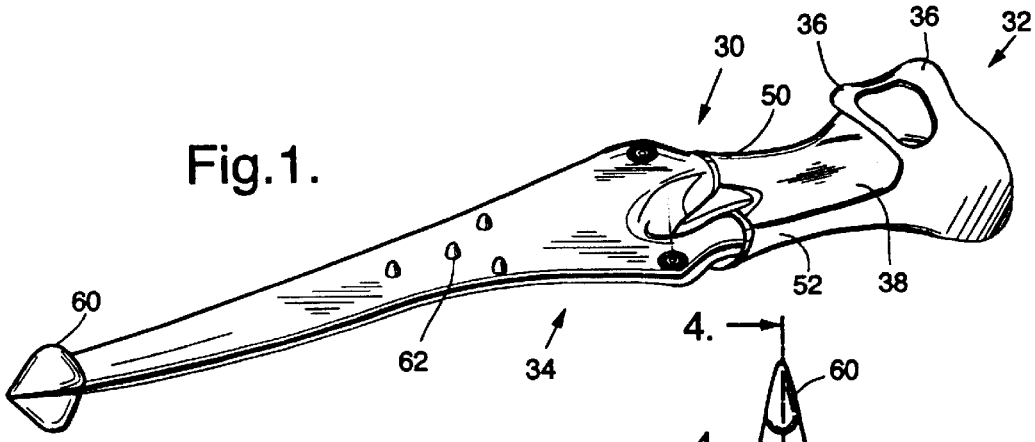
FIG. 1 shows a left side perspective view of a first embodiment of a narrow spear-bladed swim fin.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention provides useful embodiments of spear-bladed swim fins. Such spear-bladed swim fins generally extend a lateral length to a significant degree more than they do in their width. In so doing, the spear-bladed swim fin blades of the present invention have a larger perimeter-to-surface area ratio than regular swim fins. Often, the blades of regular swim fins are wide and flat in order to provide more surface area with which to propel the diver through the water as he or she (hereinafter "he") swims through the water. When the diver kicks his feet, the surface of the swim fin then engages the water and serves to push against the water in order to propel the diver.

The spear-bladed swim fins of the present invention generally have significantly less surface area and more edge or perimeter than is normally found in more casually-designed swim fins. In so doing, it may be easier for the diver to maintain the position, rather than to propel himself through the water. This may be particularly advantageous for those who must remain stationery in the water. Additionally, the undulating motion of the fin may provide additional propulsive action by the spear-bladed swim fin.

As an example of the use of the spear-bladed swim fins of the present invention, underwater cameramen or the like are often required to maintain a position over a long period of time. Rather than using regular swim fins and not kicking or moving the legs in the water (which would propel the cameraman away from his preferred stationery position), spear-bladed swim fins of the present invention may allow the diver to continuously engage in a comfortable kicking motion while maintaining his position as an underwater camera operator.

Due to the lateral extension of the spear-bladed swim fins of the present invention along their length, the blades have a tendency to undulate with a wave-like pattern running along the length of the hydrofoil, or fin portion, of the swim fin. In so undulating, the hydrofoil may resemble a whip in its operation. The undulating wave may be taller at the trailing edge than at the leading edge and may cycle faster at the trailing edge than at the leading edge. Water is accelerated as it travels along the blade to meet the faster moving water at the undulating trailing edge. The narrower nature of the distal trailing edge (as compared to the leading edge) allows it to whip through the water without creating dispersive turbulence. Currently, there is an apparent relation between the displacement of the trailing edge, its speed, and the speed of the water travelling along the perimeter such that the water accelerates behind the swim fin or prevents dispersive turbulence.

In order to provide more advantageous operations and features to the spear-bladed swim fins herein, speed pods may be used in order to eliminate dead areas adjacent the swim fin blades. A speed pod at the trailing edge may be one way in which a counterweight is created to accelerate and stabilize the trailing edge as it undulates in a whip-like manner. As is known in the art, when the blade moves through the water, the lee or trailing surfaces of the swim fin blade may be subject to lower pressure. Such low pressure generally has a tendency to increase the inertia of the swim fin and slow it down as it moves the water. Such low pressure areas also serve to hold the swim fin blade back, preventing it from going forward and providing a pushing surface against the adjacent water. Speed pods are used to fill the areas normally generating dead water. By filling the dead water space with an extension of the fin, the water then travelling about the speed pod is no longer dead, and the speed pod only adds a small amount of inertia without adding any low pressure area to hold the swim fin blade back. Generally, with a spear-bladed swim fin, dead spots are less of a concern. As set forth further below, when the length and tension of the blade are optimized for load, medium, surf, and other conditions, dead spots are minimized. Generally, the spear-bladed swim fin of the present invention operates free of turbulence.

Speed pods may also be used to provide counterweights and/or vortex generators that allow the better operation of a spear-bladed swim fin of the present invention. In one embodiment, the speed pod may be equally weighted on both sides. This allows an equal balance on any moment arms extending to this speed pod and torques related thereto. Alternatively, the speed pod may be biased on one side with a solid portion on one side of the hydrofoil and a hollow portion on the other. The hollow side can be used to create the beneficial vortices in a manner different from that of the regular, equally-balanced and protruding speed pod. This is particularly advantageous when the configuration, placement, or direction of the movement of the hydrofoil or blade draws more or less water on one side than another. By selectably arranging the configuration of hydrofoil blades in conjunction with appropriately weighted speed pods, performance delivered by the swim fin of the present invention may be improved.

Figure 13:
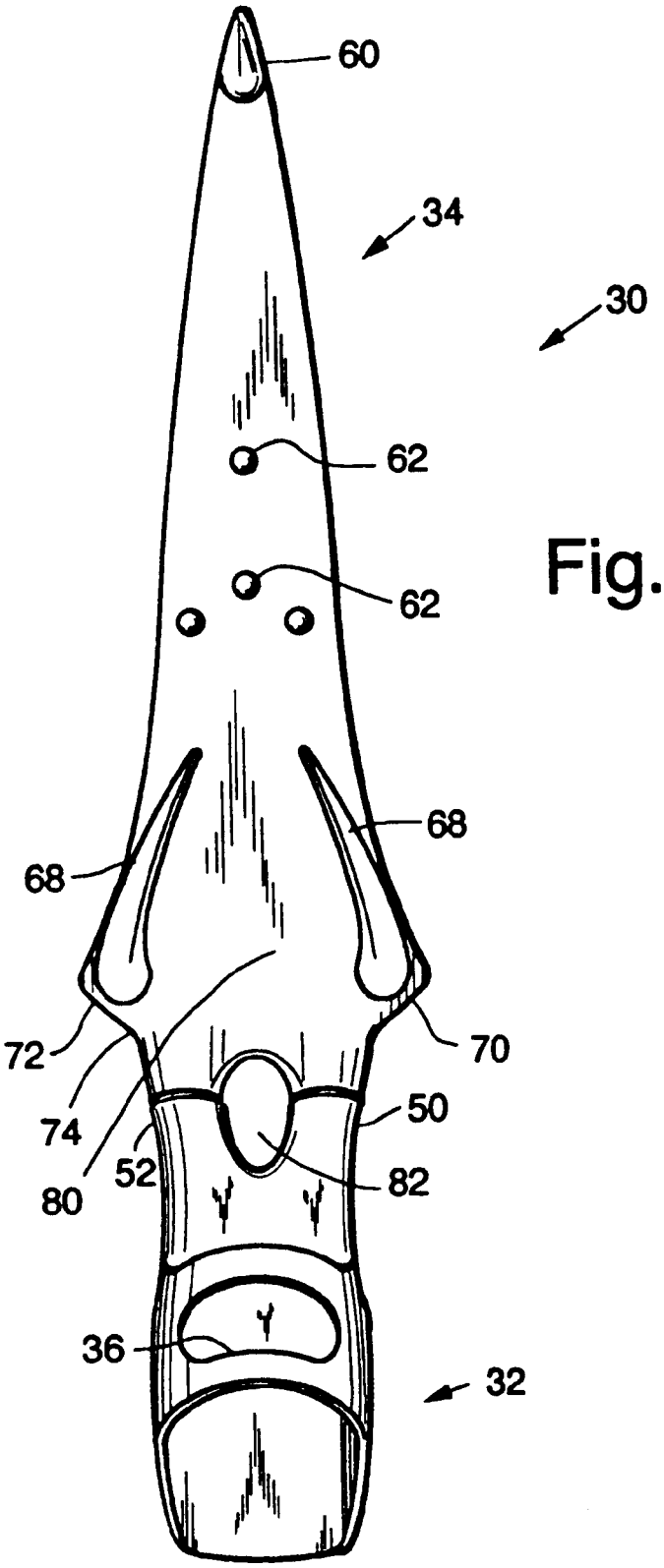
FIG. 13 is a top plan view of the swim fin shown in FIG. 1 with the addition of winglets upon the clock washers at the flared portions thereof.

Additionally, clock washers may be used in order to provide adjustable means by which either the swim fin blade may be adjustably fastened to the foot pocket (FIGS. 1 and 14), as well as allowing winglets or the like to adjustably engage the swim fin blade (FIG. 13). As is known in the art, clock washers are ridged, circular washers that engage a second meshing clock washer in order to provide a stable but adjustable articulation of associated structures. The structures are rotatable with respect to one another, but the force required to overcome the obstructing ridges of the meshing clock washers is generally significantly greater than that engaged in normal operation. Alternatively, bolts, screws, or other fasteners used to attach the structures together may be loosened in order to disengage the clock washers from one another during adjustment.

Other features of the spear-bladed swim fins include the use of a propitiously-defined aperture through which water may flow and even be guided by the surface of the blade portion of the spear-bladed swim fin. The flow of water through such apertures prevents the creation of dead water adjacent the surfaces of the swim fin. By eliminating such dead areas, the swim fin operates more efficiently and requires less strength and endurance upon the part of the diver. Additionally, and in conjunction with the other edges and surfaces of the fin, vortices may be forwarded that advantageously contribute to the operation and performance of the spear-blade swim fin.

The present invention uses specially-configured hydrofoil blades attached to a foot pocket with fork extension stubs. The hydrofoil blade may be articulated with respect to the fork extension stubs in the foot pocket. The selectable articulation of the blade with respect to the foot pocket affects the operation of the spear-bladed swim fin of the present invention. Tightening of the membrane that is the hydrofoil at the leading fixture point adjacent the fork extension stub shortens the wavelength of the hydrofoil blade as it undulates. By loosening or tightening this membrane, the length of the oscillating wave pattern can be adjusted. By varying the length and speed of the oscillation wave, control is exercised over the propulsion generated by such oscillation. This is particularly useful when adjusting the oscillation to optimize the efficiency of the undulating wave relative to the waves in the water medium. As the length and tension of the blade, as well as oscillation speed, can be adjusted in order to optimize swim fin performance for the water medium, and surf conditions, a better means of aquatic propulsion is provided.

Turning now to the drawings, FIGS. 1–13 show a first embodiment of the spear-bladed swim fin of the present invention. In the drawings, the narrow blade embodiment 30 of the present invention has a foot pocket portion 32 to which the spear-shaped swim fin blade 34 is attached. The foot pocket 32 is one that is generally known in the art, having ankle straps 36 and a foot supporting portion 38. As shown in FIG. 1, the foot pocket 32 may be open-ended. However, a heel strap or the like (not shown) may be used. FIG. 7 shows a heel pocket 40 that serves to retain the foot in the foot pocket by urging the heel towards the ankle straps 36.

Of note with respect to the foot pocket 32 are fork extension stubs 50, 52. The fork extension stubs 50, 52 provide sockets within which clock washers are held or formed. These clock washers (not shown) mesh with clock washers in plugs extending outwardly from the spear blade. As shown in FIG. 8, a recess 54 provides access to the rear of the left fork extension stub 52. When centrally drilled, the recess 54 provides access for a bolt, screw, or other faster means by which the spear blade 34 may be attached to the foot pocket 32 at the fork extension stubs 50, 52. As set forth in more detail below, this connection between the foot pocket 32 and the spear blade 34 is of some significance because the articulation of the spear blade 34 with respect to the fork extension stubs provide adjustable, dynamic, and unique characteristics and performance.

Figure 2:
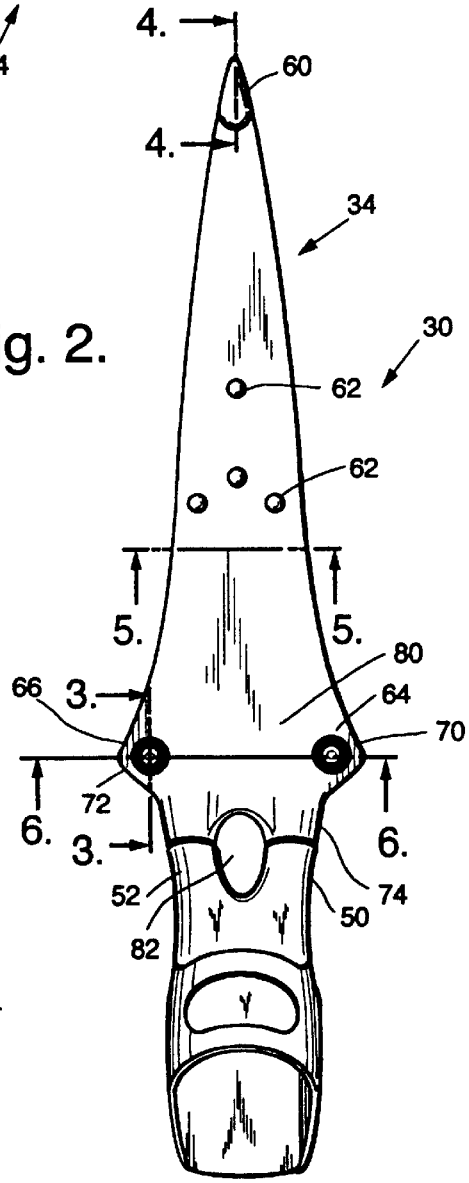
FIG. 2 is a top plan view of the spear-bladed swim fin of FIG. 1.
Figure 4:
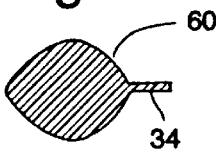
FIG. 4 is a side cross-sectional view of a speed pod, at the tip of the spear-bladed swim fin of FIG. 2 taken along line 4—4.

In order to provide better operation, the spear-bladed swim fin 30 incorporates a speed pod 60 at its distal end, as well as speed bumps 62 generally distributed near the center of the spear blade 34. The speed pod 60 and speed bump 62 are as shown in FIG. 2. FIG. 4 shows the speed pod 60 in cross section.

Figure 3:
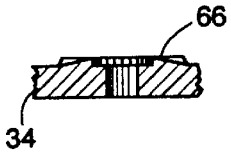
FIG. 3 is a side cross-sectional view of a clock washer used at a flared portion of the spear-bladed swim fin shown in FIG. 2 taken along line 3—3.

Also shown in FIG. 2 are the blade surface clock washers 64, 66. FIG. 3 shows a side cross-sectional view of the left clock washer 66. The clock washers 64, 66 provide a seat upon which flow-directing winglets 68 (FIG. 13) may be attached to the outwardly-extending flares 70, 72 adjacent the proximal end 74 of the spear blade 34.

Figure 5:
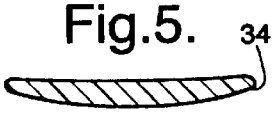
FIG. 5 is a cross-sectional view of the spear-bladed swim fin taken along line 5—5 of FIG. 2. A
Figure 6:
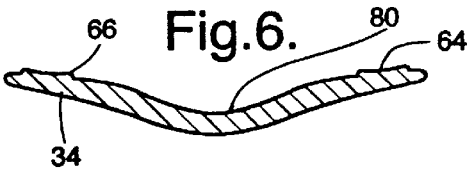
FIG. 6 is a cross-sectional view of the spear-bladed swim fin blade taken along line 6—6 of FIG. 2.
Figure 11:
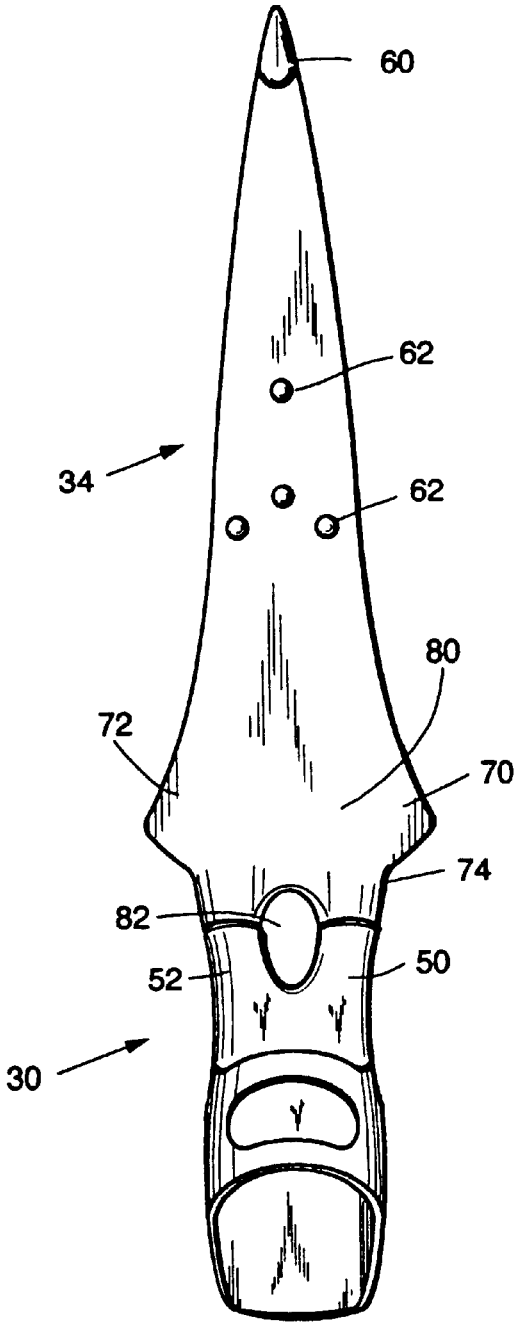
FIG. 11 is a top plan view of the swim fin shown in FIG. 7 without a heel cup.
Figure 12:
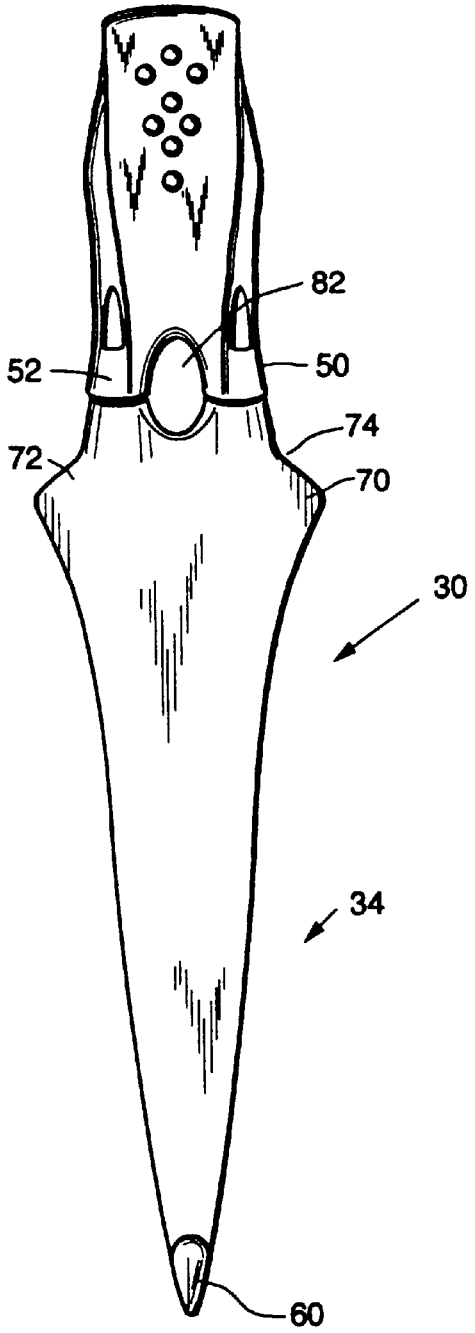
FIG. 12 is a bottom plan view of the swim fin shown in FIG. 7.

FIGS. 5 and 6 show different cross sections present in different areas of the spear blade 34. FIG. 5 is taken proximate the speed bump 62 and shows a thicker but narrower cross section, whereas the cross section noted in FIG. 6 is wider, somewhat thinner, and much less flat (taking an arched path). The cross section shown in FIG. 6 is taken along line 6—6 of FIG. 2, across the blade surface clock washers 64, 66 and the outwardly-extending flares 70, 72.

To be noted is an indentation or depression 80 forward of the aperture 82. As shown in FIG. 2, the depression 80 on the, top side of the swim fin 30 gives rise to an upwelling or rise on the bottom side of the swim fin 30 (FIG. 8). The depression side of the swim fin allows channeling of the water through the aperture 82, while the upwelling may create an area of low pressure that serves to draw the water through the aperture 82. Additionally, the flow of water through the aperture 82 may serve to create flow across the bottom of the swim fin 30. This water flow reduces the presence of dead areas and allows more efficient propulsion and control from the use of the swim fin. Adjustment of the aperture 82 by rotating the blade 34 with respect to the foot pocket 32 adjusts drawing of water to the opposite side of said spear-shaped blade 34.

The spear blade 34 may have an indentation or depression 80 that serves to direct the flow of water into the aperture 82 conjunctively defined by the proximal end of the spear blade 34 and the left and right fork extension stubs 50, 52. By directing the flow of water over the blade indentation 80 and into the aperture 82, the diver's kicking motion then serves to direct the flow of water through the fin 30, preventing the creation of dead water adjacent the swim fin surface.

Figure 18:
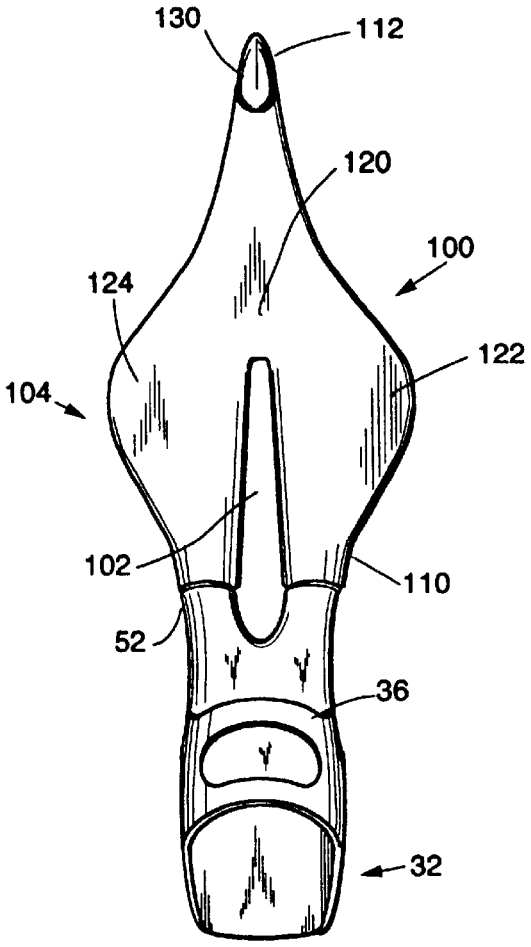
FIG. 18 is a top plan view of the swim fin shown in FIG. 14 without a heel cup.
Figure 19:
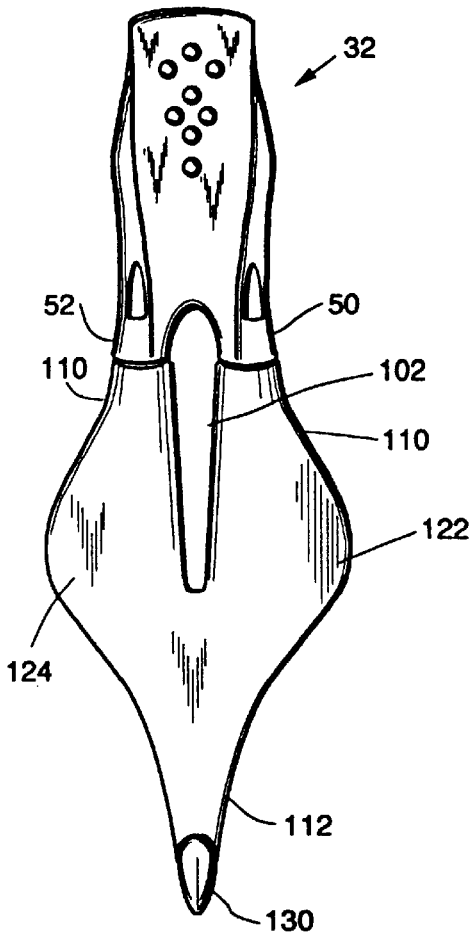
FIG. 19 is a bottom plan view of the swim fin shown in FIG. 14.

As shown in FIGS. 14–19, an alternative embodiment of the present invention resides in a wider spear blade 100, having a much larger aperture 102 as the void defined by the spear blade extends interiorly to the spear blade 100 to a much greater degree than is present for the narrow spear blade embodiment 30. The wide blade embodiment 104 of the present invention is shown in FIGS. 18 and 19. The extensively greater width of the spear blade 100 is readily perceived, as is the longer and inwardly extending aperture 102. The wider portion of the spear blade 100 is approximately one-third of the way between the proximal end 110 of the blade 100 and its distal end 112.

The foot pocket 32 used in the wide blade embodiment 104 of.the swim fin is generally the same as that used for the narrow blade embodiment 30. Consequently, the reference numbers used to refer to the foot pocket 32 portion of the wide blade embodiment 104 is similar as for those of the narrow blade embodiment 30.

The wide spear blade 100 may serve to guide water into the aperture 102 by means of an indentation or depression 120 formed between the two flared ends 122, 124 present on either side of the aperture. In so guiding the flow of the water into the aperture 102, the indentation helps prevent dead areas on both sides of the fin due to the flow of water through the aperture 102.

The wider nature of the wide spear blade embodiment 104 serves to provide more fin surface area against which the water may operate. Additional perimeter edge area is also present due to the outward extension of the flares 122, 124. Additionally, otherwise propulsive blade area is lost to the aperture 102 and its intrusion into the main spear blade portion 100 of the wide spear blade fin 104.

One advantage to the wide spear blade fin 104 is that by turning his ankles, the diver is able to provide thrust in sideways manners, thus allowing for greater attitudinal or dispositional control.

As for the narrow spear blade embodiment 30, a speed pod 130 is present at the distal end 112 of the wide spear blade 100. The speed pod 130 operates in manner similar to that of the speed pod 60 shown with the narrow spear blade embodiment.

Figure 20A:
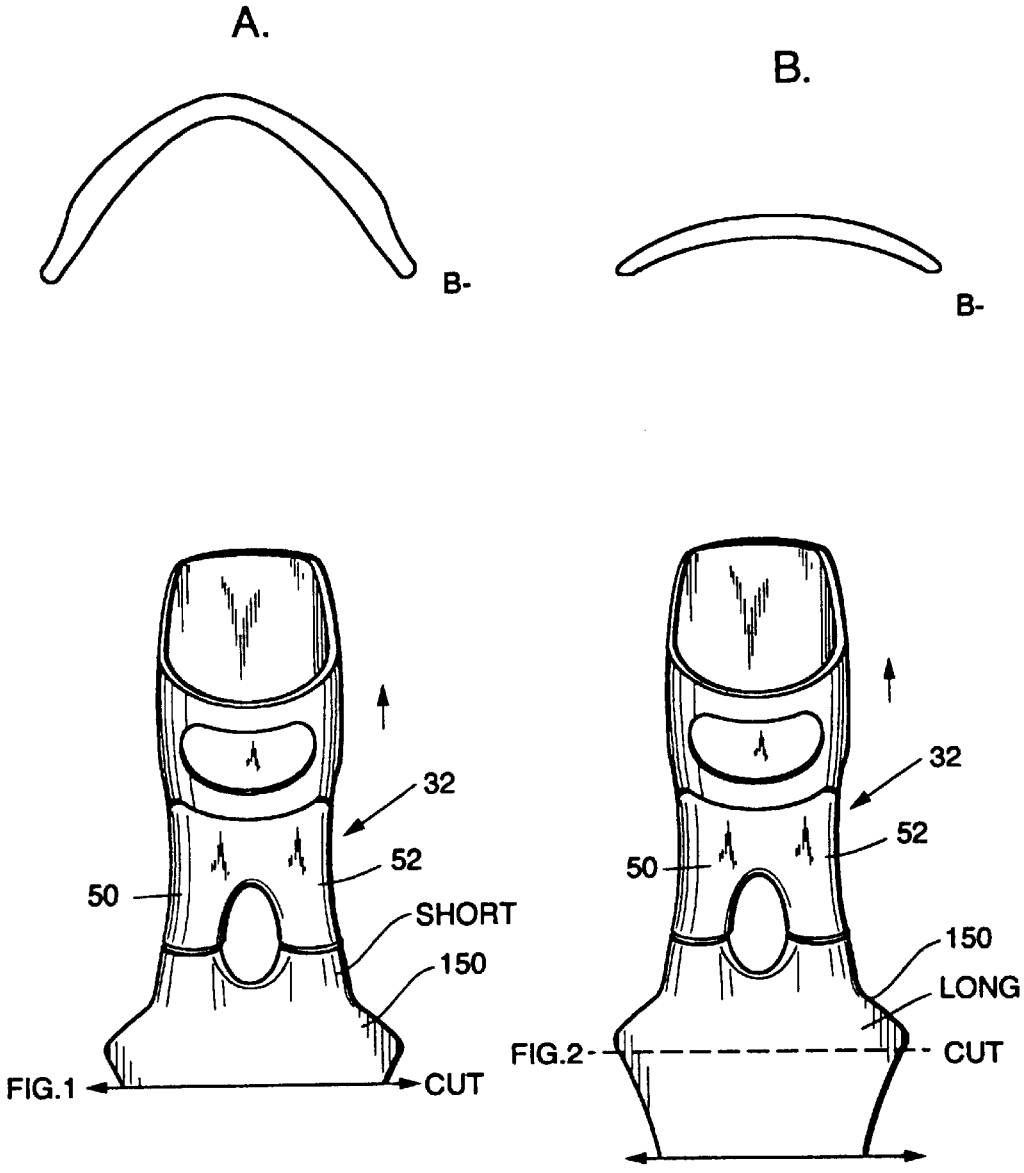
FIGS. 20A, 20B, and 20C comprise a mosaic as indicated in FIG. 20D.
Figure 20D:
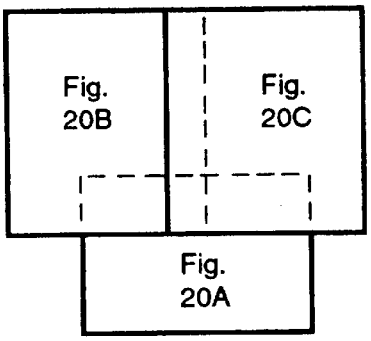
Figure 20C:
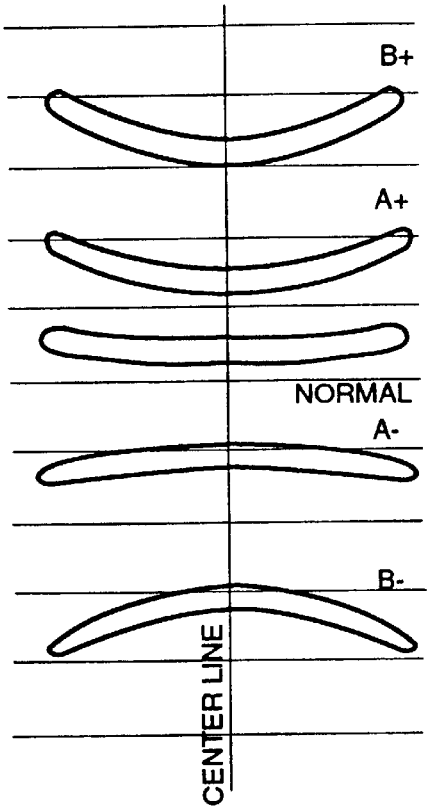
Figure 20B:
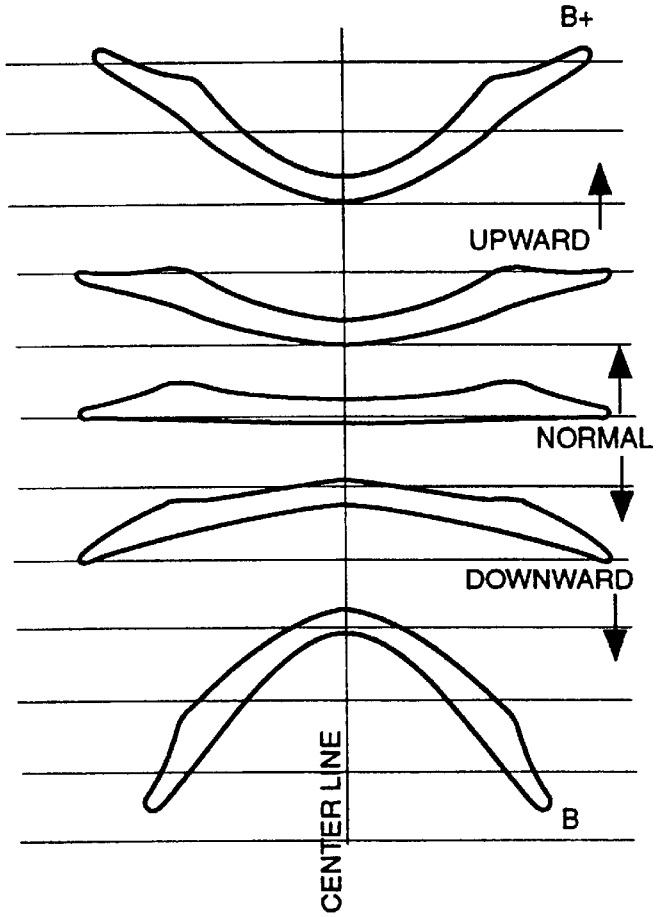

FIGS. 20A–C (as indicated by FIG. 20D) indicate the selectable adjustment of the swim fin blades 34, 100, depending upon their fixation to the foot pocket 32. Alternatively, and possibly in conjunction with the adjustable flexion of the swim fin blades 34, 100, the position where the flexing is determined may be reflected by the FIGS. 20A–C. For example, the swim fin marked A may generally correspond to the line 6—6 in FIG. 2. The swim fin marked B may correspond to the line 5—5 in FIG. 2. For the swim fin marked A (to the left in the FIG. 20 drawings), the swim fin blade 150 has been installed upon the foot pocket 32 in a significantly-flexed manner, either upward ($B^+$) or downward ($B^-$). In these high settings, more water is scooped or drawn onto one side of the blade when it is activated by moving it up or down. For the $B^+$ configuration, more water is going to be scooped or drawn to the top side of the blade. For $B^-$ in FIG. 20B, much higher volume water is drawn to the bottom side of the blade than the top.

The same is similarly true in a diminished manner for configurations $A^+$ and $A^-$ of FIG. 20B. More water is drawn to the top side in FIG. $A^+$, but the differential between the top and bottom is less. The reverse is true for configuration $A^-$ in FIG. 20B, and more water is drawn to the bottom side than the top. For the center drawing (marked "normal"), the position is neutral and equal amounts of water are drawn to the top and bottom side of the blade.

One way in which such a significantly-flexed manner may be achieved by the swim fin blade 150 is by rotating the blade 150 with respect to the clock washers and the fork extension stubs 50, 52. By rotating each extension of the swim fin blade 150 in opposite directions (clockwise and counter clockwise or vice versa), the swim fin blade is forced to flex about its central axis.

The same is similarly true for the drawings shown in FIG. 20C. The plane of flexion is shown at the cut and generally corresponds to the "cut" shown in fin B of FIG. 20A. As mentioned above, the cut shown in fin B of FIG. 20A may generally correspond to line 5—5 of FIG. 2. The cross sections shown in FIG. 20C correspond to significant flexing at $B^+$ and $B^-$ with lesser flexing at $A^+$ and $A^-$ and no flexing at "normal." As set forth above, the different degrees of flexing controls the draw of water across the hydrofoil blade.

The degree to which the swim fin blade 150 bows or flexes allows the diver to more greatly control the operation of the swim fin as a whole. Consequently, more control is delivered to the diver, which such convenience is additionally enhanced by the adjustable nature of such flexing and/or bowing.

While the present invention has been described with regards to particular embodiments, it is recognized that additional variations of the present invention may be devised without departing from the inventive concept.

What is claimed is:

1. A spear-bladed swim fin, comprising:

a foot pocket, said foot pocket receiving a foot; and a spear-shaped swim fin blade coupled to said foot pocket, said spear-shaped blade defining an aperture through which water may flow and having a surface area surrounded by an edge perimeter, said spear-shaped blade extending away from said foot pocket and terminating at a distal end in a substantially narrow and pointed end and further comprising:

first and second laterally convex flares, said flares coupled to said spear-shaped blade generally adjacent a proximal end thereof, said flares being convex and on opposite sides of said spear-shaped blade and further comprising:

a first adjustable fastener, said first adjustable fastener coupled to said first convex flare;

a second adjustable fastener, said second adjustable fastener coupled to said second convex flare; whereby a diver's swim-kick energy undulates said swim fin blade for propulsion.

2. The spear-bladed swim fin of claim 1, further comprising:

a first winglet, said first winglet coupled to said first adjustable fastener, said first winglet guiding water adjacent said spear-shaped blade; and a second winglet, said second winglet coupled to said second adjustable fastener, said second winglet guiding water adjacent said spear-shaped blade; whereby said first and second winglets selectably and adjustably enhance performance of the spear-bladed swim fin by providing adjustable water flow.

3. The spear-bladed swim fin of claim 1, further comprising:

a speed pod, said speed pod coupled to a distal end of said spear-shaped swim fin blade.

4. The spear-bladed swim fin of claim 3, further comprising a speed bump, said speed bump located on a surface of said spear-bladed swim fin blade.

5. The spear-bladed swim fin of claim 4, further comprising:

said spear-shaped blade defining a depression adjacent said aperture;

said depression channeling water towards said aperture;

said aperture allowing water flow through the spear-bladed swim fin; whereby water flowing through said aperture reduces dead spots on a lee side of the spear-bladed swim fin.

6. A spear-bladed swim fin, comprising:

a foot pocket, said foot pocket receiving a foot; and a spear-shaped swim fin blade coupled to said foot pocket, said spear-shaped blade defining an aperture through which water may flow and having a surface area surrounded by an edge perimeter, said spear-shaped blade extending away from said foot pocket and terminating at a distal end in a substantially narrow and pointed end and further comprising:

a speed bump, said speed bump located on a surface of said spear-bladed swim fin;

a speed pod, said speed pod coupled to a distal end of said spear-shaped swim fin blade;

first and second laterally convex flares, said flares coupled to said spear-shaped blade generally adjacent a proximal end thereof, said flares being convex and on opposite sides of said spear-shaped blade and further comprising:

a first adjustable fastener, said first adjustable fastener coupled to said first convex flare;

a second adjustable fastener, said second adjustable fastener coupled to said second convex flare;

said spear-shaped blade defining a depression and an aperture;

said depression channeling water towards said aperture;

said aperture allowing water flow through the spear-bladed swim fin; whereby water flowing through said aperture reduces dead spots on a lee side of the spear-bladed swim fin and further comprising:

said spear-shaped blade being adjustably attached to said foot pocket; whereby tension upon said spear-shaped blade is adjustable and controls water flow across said spear-shaped blade.

7. The spear-bladed swim fin of claim 6, further comprising:

adjustment of said aperture adjusts drawing of water to an opposite side of said spear-shaped blade; whereby water flow across said spear-shaped blade is further adjustable.

8. An adjustable blade swim fin, comprising:

a foot pocket, said foot pocket receiving a foot; and an adjustable swim fin blade coupled to said foot pocket, said adjustable swim fin blade defining an aperture through which water may flow, said aperture having an adjustable surface area defined by the edge perimeter of said adjustable blade of said swim fin, said adjustable blade extending away from said foot pocket and terminating at a distal end;

wherein rotation of the proximal end of said adjustable blade defines the size of said aperture and thus, the amount of water flowing therethrough;

said adjustable fin having a duality of adjustable first and second swim fin blade plugs and having first and second laterally convex flares, said flares coupled to said adjustable swim fin blade plugs generally adjacent a proximal end thereof, said flares being convex and on opposite sides of said adjustable swim fin blade; a first adjustable fastener, said first adjustable fastener coupled to said first convex flare;

a second adjustable fastener, said second adjustable fastener coupled to said second convex flare; whereby a diver's swim-kick energy undulates said swim fin blade for propulsion and adjustment of said adjustable blade changes the flow through characteristics of said aperture.

9. The swim fin of claim 8, further comprising:

a first winglet, said first winglet coupled to said first adjustable fastener, said first winglet guiding water adjacent said first adjustable blade; and a second winglet, said second winglet coupled to said second adjustable fastener, said second winglet guiding water adjacent said second adjustable blade; whereby said first and second winglets selectably and adjustably enhance performance of the adjustable swim fin by providing adjustable water flow.

10. The swim fin of claim 9, wherein the distal end of said adjustable swim fin is spear shaped in configuration and further comprising:

a speed pod, said speed pod coupled to a terminus area of said spear-shaped swim fin blade.

11. The swim fin of claim 10, further comprising a speed bump, said speed bump located on a surface of the distal portion of said spear-bladed swim fin blade.

12. The swim fin of claim 11, further comprising:

said adjustable swim fin defines a depression adjacent said aperture;

said depression channeling water towards said aperture;

said aperture allowing water flow through the swim fin; whereby water flowing through said aperture reduces dead spots on a lee side of said swim fin.

13. The swim fin of claim 12, further comprising:

said first and second swim fin blade plugs being adjustably attached to said foot pocket; whereby tension upon said first and second blade plugs is adjustable and controls water flow across said swim blade.

14. The spear-bladed swim fin of claim 13, further comprising:

adjustment of said aperture adjusts drawing of water to an opposite side of said swim fin; whereby water flow across said swim fin is further adjustable.

15. An adjustable blade swim fin, comprising:

a foot pocket, said foot pocket receiving a foot; and an adjustable swim fin blade coupled to said foot pocket, said adjustable swim fin blade defining an aperture through which water may flow, said aperture having an adjustable surface area defined by the edge perimeter of said adjustable blade of said swim fin, said adjustable blade extending away from said foot pocket and terminating at a distal end;

wherein rotation of the proximal end of said adjustable blade defines the size of said aperture and thus, the amount of water flowing therethrough;

said adjustable fin having a duality of adjustable first and second swim fin blade plugs and having first and second laterally convex flares, said flares coupled to said adjustable swim fin blade plugs generally adjacent a proximal end thereof, said flares being convex and on opposite sides of said adjustable swim fin blade;

said first and second convex flares extending outwardly so as to provide additional surface area of said first and second swim fin blade plugs; and said swim fin defining an elongated aperture;

said first and second convex flares aiding said first and second swim fin blade plugs in defining an indentation, said indentation channeling water towards said elongated aperture; whereby a diver's swim-kick energy undulates said swim fin blade for propulsion and adjustment of said adjustable blade changes the flow through characteristics of said aperture.

* * * * *